US007535444B2

(12) United States Patent
Kim

(10) Patent No.: US 7,535,444 B2
(45) Date of Patent: May 19, 2009

(54) ORGANIC LIGHT-EMITTING DISPLAY DEVICE INCLUDING PIXELS COMMONLY HAVING INITIALIZATION SWITCHING ELEMENT AND POWER SUPPLY ELEMENT

(75) Inventor: Yang-Wan Kim, Suwon-si (KR)

(73) Assignee: Samsung Mobile Display Co., Ltd., Suwon (KR)

( * ) Notice: Subject to any disclaimer, the term of this patent is extended or adjusted under 35 U.S.C. 154(b) by 691 days.

(21) Appl. No.: 11/197,355

(22) Filed: Aug. 5, 2005

(65) Prior Publication Data

US 2006/0028410 A1 Feb. 9, 2006

(30) Foreign Application Priority Data

Aug. 6, 2004 (KR) ..... 10-2004-0061951

(51) Int. Cl.
*G09G 3/32* (2006.01)

(52) U.S. Cl. ..... 345/82; 345/83

(58) Field of Classification Search ..... 345/1.1, 345/39, 44, 76–83, 87, 92, 98, 100, 102, 345/108, 204, 211, 212, 698, 175, 589; 315/169.3, 315/150, 149, 154, 291; 714/727, 731, 726; 257/59, 40, 98, 72; 313/504; 324/537; 341/144
See application file for complete search history.

(56) References Cited

U.S. PATENT DOCUMENTS

| | | | | |
|---|---|---|---|---|
| 5,745,105 | A * | 4/1998 | Kim | 345/212 |
| 6,097,378 | A * | 8/2000 | Song | 345/211 |
| 6,580,952 | B2 * | 6/2003 | Fukuda et al. | 700/83 |
| 6,872,973 | B1 * | 3/2005 | Koyama et al. | 257/59 |
| 7,170,504 | B2 * | 1/2007 | Noguchi et al. | 345/204 |
| 7,379,039 | B2 * | 5/2008 | Yumoto | 345/82 |
| 2002/0075252 | A1 * | 6/2002 | Lee | 345/211 |
| 2004/0061694 | A1 * | 4/2004 | Noguchi et al. | 345/204 |
| 2004/0145556 | A1 * | 7/2004 | Nakanishi | 345/99 |
| 2005/0046619 | A1 * | 3/2005 | Senda et al. | 345/76 |
| 2005/0200296 | A1 * | 9/2005 | Naugler et al. | 315/150 |

* cited by examiner

*Primary Examiner*—Prabodh M. Dharia
(74) *Attorney, Agent, or Firm*—H.C. Park & Associates, PLC

(57) ABSTRACT

An organic light-emitting display device including pixels commonly having an initialization switching element and a power supply element. The organic light-emitting display device has a first type pixel and a second type pixel. The first type pixel generates a first initialization voltage corresponding to an initialization signal and the second type pixel generates a first power corresponding to a power source. The first and second pixels share the first initialization voltage and the first power. The first and second pixels are optimally arranged to be provided with uniform power source.

15 Claims, 5 Drawing Sheets

ORGANIC LIGHT-EMITTING DISPLAY DEVICE INCLUDING PIXELS COMMONLY HAVING INITIALIZATION SWITCHING ELEMENT AND POWER SUPPLY ELEMENT

CROSS-REFERENCE TO RELATED APPLICATION

This application claims priority to and the benefit of Korean Patent Application No. 10-2004-0061951, filed on Aug. 6, 2004, which is hereby incorporated by reference for all purposes as if fully set forth herein.

BACKGROUND OF THE INVENTION

1. Field of the Invention

The present invention relates to an organic light-emitting display device and, more particularly, to an organic light-emitting display device including pixels having an improved circuit structure.

2. Discussion of the Background

FIG. 1 is a block diagram showing a conventional organic light-emitting display device. Referring to FIG. 1, the organic light-emitting display device includes a plurality of pixels 10 and 11. The pixel 10 receives a high power source $V_{DD}$, an nth scan signal Scan[n], an (n−1)th scan signal Scan[n−1], an initialization signal Init, an nth emission control signal em[n], and an mth data signal data[m] to drive an organic light emitting diode (OLED) to emit light. The pixel 11 receives the high power source $V_{DD}$, the nth scan signal Scan[n], the (n−1)th scan signal Scan[n−1], the initialization signal Init, the nth emission control signal em[n], and an (m+1)th data signal data[m+1] to drive an OLED to emit light.

Hence, in the conventional organic light-emitting display device of FIG. 1, each pixel 10 and 11 receives the high power source $V_{DD}$, the nth scan signal Scan[n], the (n−1)th scan signal Scan[n−1], the initialization signal Init, the nth emission control signal em[n], and corresponding data signals.

FIG. 2 is a block diagram showing another conventional organic light-emitting display device. Referring to FIG. 2, each pixel 20 and 21 receives the high power source $V_{DD}$, the nth scan signal Scan[n], the (n−1)th scan signal Scan[n−1], the initialization signal Init, the nth emission control signal em[n], and corresponding data signals, similarly to the pixels 10 and 11 of the organic light-emitting display device of FIG. 1.

A difference between the organic light-emitting devices is that a high power source VDD is provided for each pixel 10 and 11 of FIG. 1, but the pixels 20 and 21 of FIG. 2 share a high power source VDD. However, both pixels in both devices receive the corresponding signals to operate.

FIG. 3 is a circuit diagram of the organic light-emitting display device of FIG. 1, and FIG. 4 is a circuit diagram of the organic light-emitting display device of FIG. 2.

Referring to FIG. 3 and FIG. 4, the circuits of the pixels 10, 11, 20 and 21 are similar in that each circuit includes six thin film transistors (TFT) and a single capacitor.

SUMMARY OF THE INVENTION

The present invention provides an organic light-emitting display device including pixels that commonly have an initialization switching element and a power supply element.

The present invention also provides an organic light-emitting display device including pixels that commonly have an initialization switching element and a power supply element and that are arranged optimally.

Additional features of the invention will be set forth in the description which follows, and in part will be apparent from the description, or may be learned by practice of the invention.

The present invention discloses an organic light-emitting display device including first and second pixels. The first pixel is operated in response to a first power, an Nth scan signal, an Nth emission control signal, an Mth data signal and a first initialization voltage and generates a second power. The second pixel is operated in response to a third power, the Nth scan signal, an (N−1)th scan signal, an initialization signal, the Nth emission control signal, an (M+1)th data signal and the second power and generates the first initialization voltage. The first initialization voltage is generated by the initialization signal and the (N−1)th scan signal, and the second power is generated by the first power and the Nth emission control signal.

The present invention also discloses an organic light-emitting display device including first and second pixels. The first pixel is operated in response to a first power supplied from a first power source line among a plurality of power source lines having the same voltage level, an Nth scan signal, an Nth emission control signal, an (M+1)th data signal and a first initialization voltage and generates a second power. The second pixel is operated in response to the first power, the Nth scan signal, an (N−1)th scan signal, an initialization signal, the Nth emission control signal, an Mth data signal and the second power and generates the first initialization voltage. The first initialization voltage is generated by the initialization signal and the (N−1)th scan signal, and the second power is generated by the first power and the Nth emission control signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
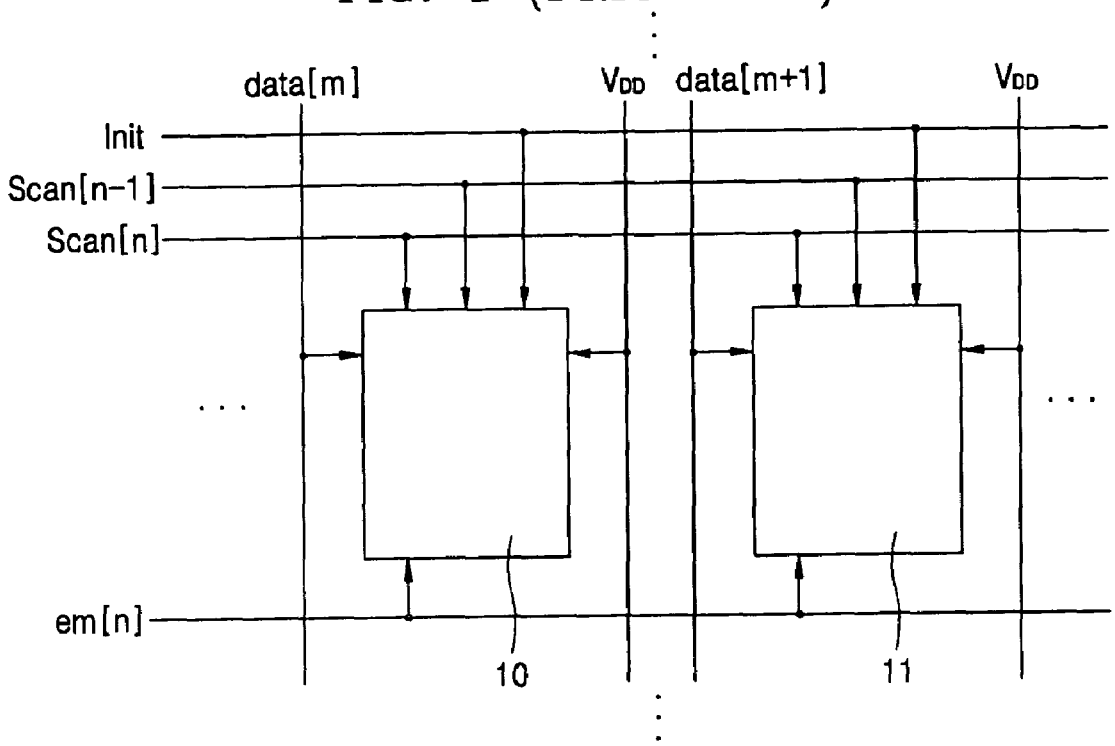
FIG. 1 (PRIOR ART)
FIG. 1 is a block diagram showing a conventional organic light-emitting display device.

Exemplary embodiments of the present invention will now be described more fully with reference to the accompanying drawings. The invention may, however, be embodied in many different forms and should not be construed as being limited to the embodiments set forth herein. Rather, these embodiments are provided so that this disclosure will be thorough and complete, and will fully convey the concept of the invention to those skilled in the art. Throughout the drawings, like reference numerals refer to like elements.

Figure 5:
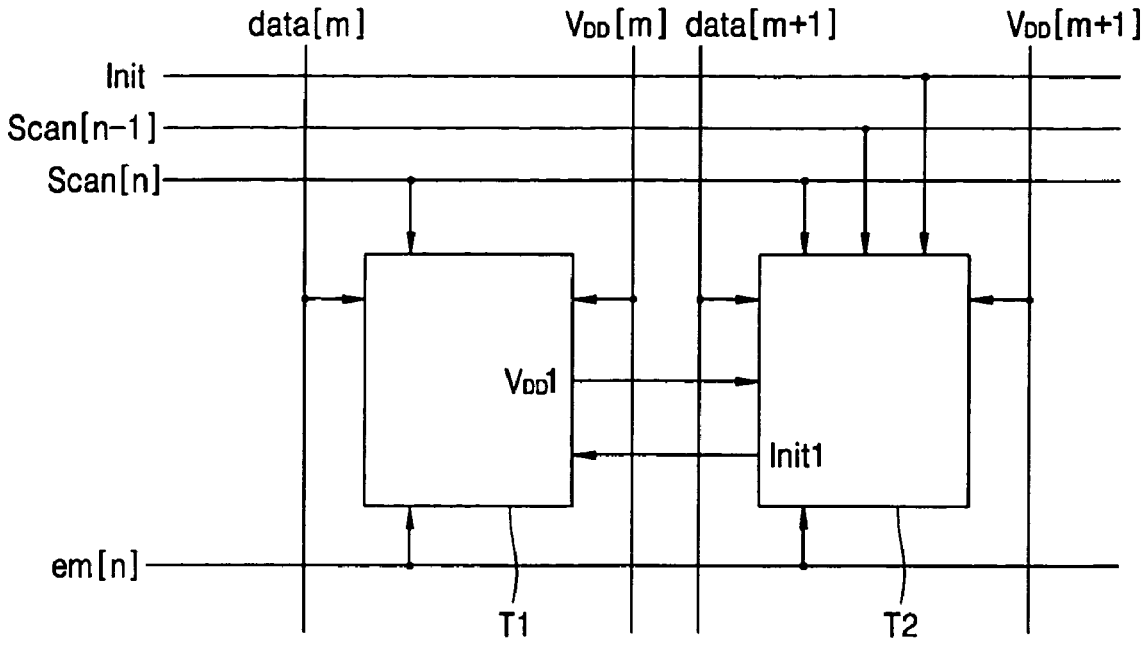
FIG. 5 is a block diagram showing an organic light-emitting display device according to an embodiment of the present invention.

FIG. 5 is a block diagram showing an organic light-emitting display device according to an embodiment of the present invention. Referring to FIG. 5, the organic light-emitting display device includes first and second pixels T1 and T2.

The first pixel T1 may operate in response to a high power source $V_{DD}$[m], an nth scan signal Scan[n], an nth emission control signal em[n], an mth data signal data[m], and a first initialization voltage Init1 and generates a first power source $V_{DD}$1. Here, n and m are integers.

The second pixel T2 may operate in response to a high power source $V_{DD}$[m+1], the nth scan signal Scan[n], an (n−1)th scan signal Scan[n−1], an initialization signal Init, the nth emission control signal em[n], an (m+1)th data signal data[m+1], and the first power source $V_{DD}$1 and generates the first initialization voltage Init1. The first initialization voltage Init1 and the first power source $V_{DD}$1 will be explained below with reference to FIG. 7.

Figure 6:
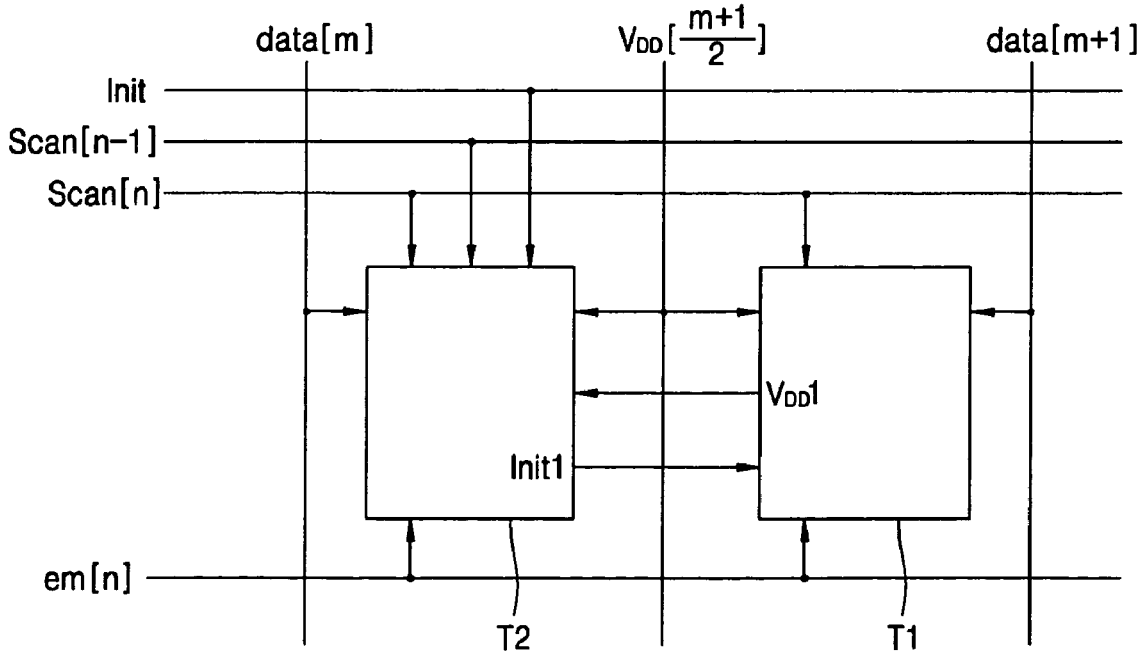
FIG. 6 is a block diagram showing an organic light-emitting display device according to another embodiment of the present invention.

FIG. 6 is a block diagram showing an organic light-emitting display device according to another embodiment of the present invention. Referring to FIG. 6, the organic light-emitting display device includes first and second pixels T1 and T2.

The first pixel T1 may operate in response to a high power source $$V_{DD}\left[\frac{m+1}{2}\right],$$

an nth scan signal Scan[n], an nth emission control signal em[n], an (m+1)th data signal data[m+1], and a first initialization voltage Init1 and generates a first power source $V_{DD}$1. Here, n and m are integers.

The second pixel T2 may operate in response to the high power source $$V_{DD}\left[\frac{m+1}{2}\right],$$

the nth scan signal Scan[n], an (n−1)th scan signal Scan[n−1], an initialization signal Init, the nth emission control signal em[n], an mth data signal data[m], and the first power source $V_{DD}$1 and generates the first initialization voltage Init1. The first initialization voltage Init1 and the first power source $V_{DD}$1 will be explained below with reference to FIG. 8.

Figure 7:
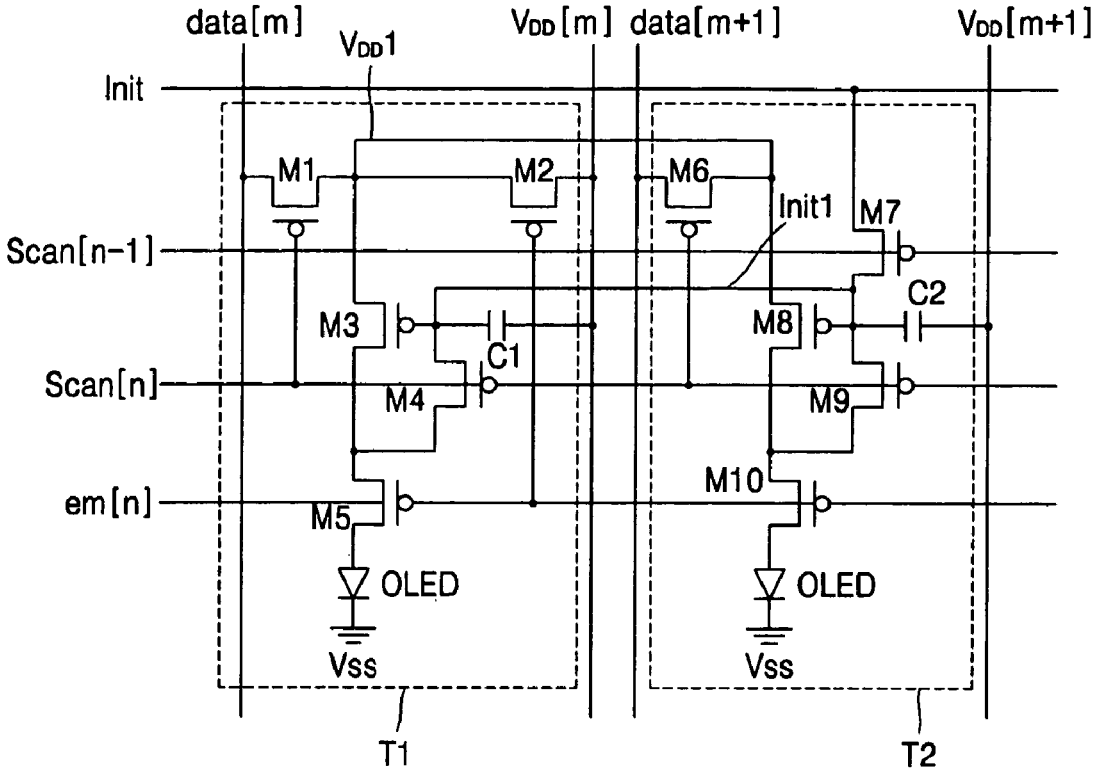
FIG. 7 is a circuit diagram of common pixels of the organic light-emitting display device of FIG. 5.

FIG. 7 is a circuit diagram of common pixels of the organic light-emitting display device of FIG. 5. Referring to FIG. 7, the organic light-emitting display device may include the first and second pixels T1 and T2. The first pixel T1 may include five TFTs M1, M2, M3, M4 and M5 and a single capacitor C1.

A first end of the first TFT M1 is provided with the mth data signal data[m], and its second end is provided with the first power source $V_{DD}$1. The nth scan signal Scan[n] is applied to the gate of the first TFT M1. A second end of the second TFT M2 is coupled to the high power source $V_{DD}$[m], and its first end is provided with the first power source $V_{DD}$1. The nth emission control signal em[n] is applied to the gate of the second TFT M2. A second end of the third TFT M3 is provided with the first power source $V_{DD}$1, and the gate of the third TFT M3 is provided with the first initialization voltage Init1. A second end of the fourth TFT M4 is provided with the first initialization voltage Init1, and its first end is coupled to a first end of the third TFT M3. The nth scan signal Scan[n] is applied to the gate of the fourth TFT M4. A second end of the fifth TFT M5 is coupled to the first end of the third TFT M3 and the first end of the fourth TFT M4. The nth emission control signal em[n] is applied to the gate of the fifth TFT M5.

A second end of the first capacitor C1 is coupled to the high power source $V_{DD}$[m], and its first end is provided with the first initialization voltage Init1. An organic light-emitting diode OLED is coupled between a first end of the fifth TFT M5 and a low power source Vss.

The second pixel T2 may include five TFTs M6, M7, M8, M9 and M10 and a single capacitor C2.

A first end of the sixth TFT M6 is provided with the (m+1)th data signal data[m+1], and its second end is provided with the first power source $V_{DD}$1. The nth scan signal Scan[n] is applied to the gate of the sixth TFT M6. A second end of the seventh TFT M7 is provided with the initialization signal Init, and its first end is provided with the first initialization voltage Init1. The (n−1)th scan signal Scan[n−1] is applied to the gate of the seventh TFT M7. A second end of the eighth TFT M8 is provided with the first power source $V_{DD}$1, and its gate is provided with the first initialization voltage Init1. A second end of the tenth TFT M10 is coupled to first ends of the eighth and ninth TFTs M8 and M9, and its gate is provided with the nth emission control signal em[n].

A second end of the second capacitor C2 is coupled to the high power source $V_{DD}$[m+1], and its first end is provided with the first initialization voltage Init1. An organic light-emitting diode OLED is coupled between the first end of the tenth TFT M10 and the low power source Vss.

Figure 8:
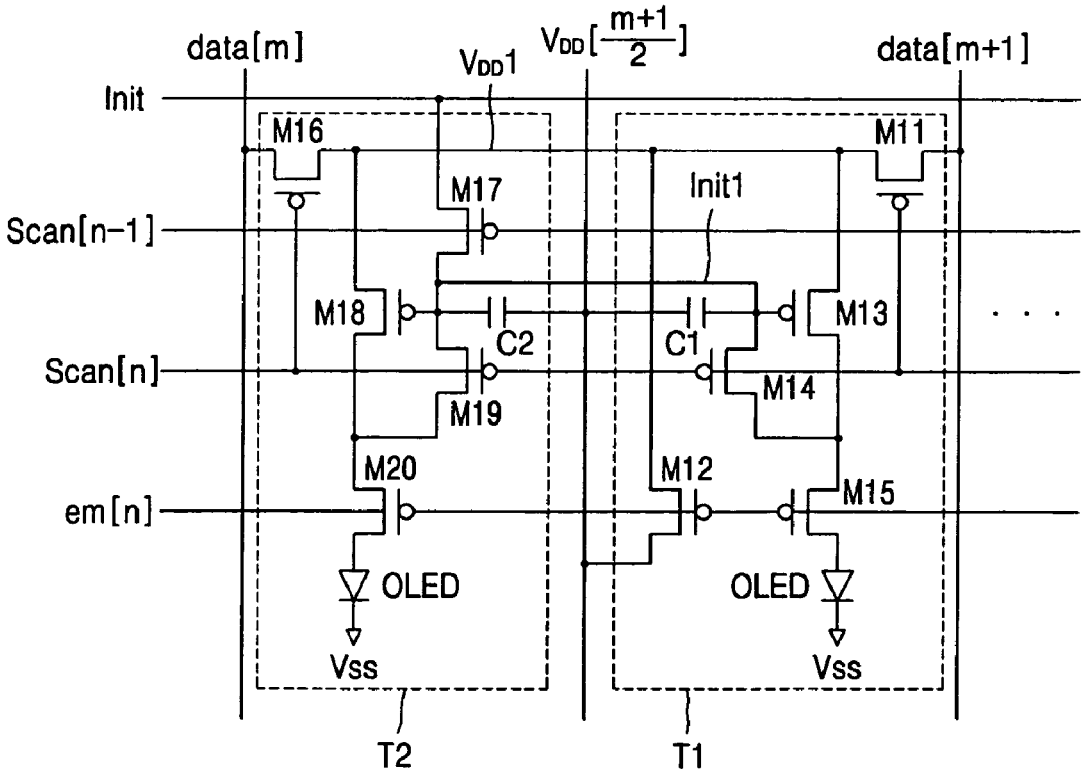
FIG. 8 is a circuit diagram of common pixels of the organic light-emitting display device of FIG. 6.

FIG. 8 is a circuit diagram of common pixels of the organic light-emitting display device of FIG. 6.

The components of the pixel circuit of FIG. 8 may be identical to the components of the pixel circuit of FIG. 7 so that explanations therefore are omitted. However, while the pixel circuit of FIG. 7 uses two power sources $V_{DD}$[m] and $V_{DD}$[m+1] for the pixels T1 and T2, the pixel circuit of FIG. 8 uses one power source $$V_{DD}\left[\frac{m+1}{2}\right]$$

for the pixels T1 and T2.

Figure 2:
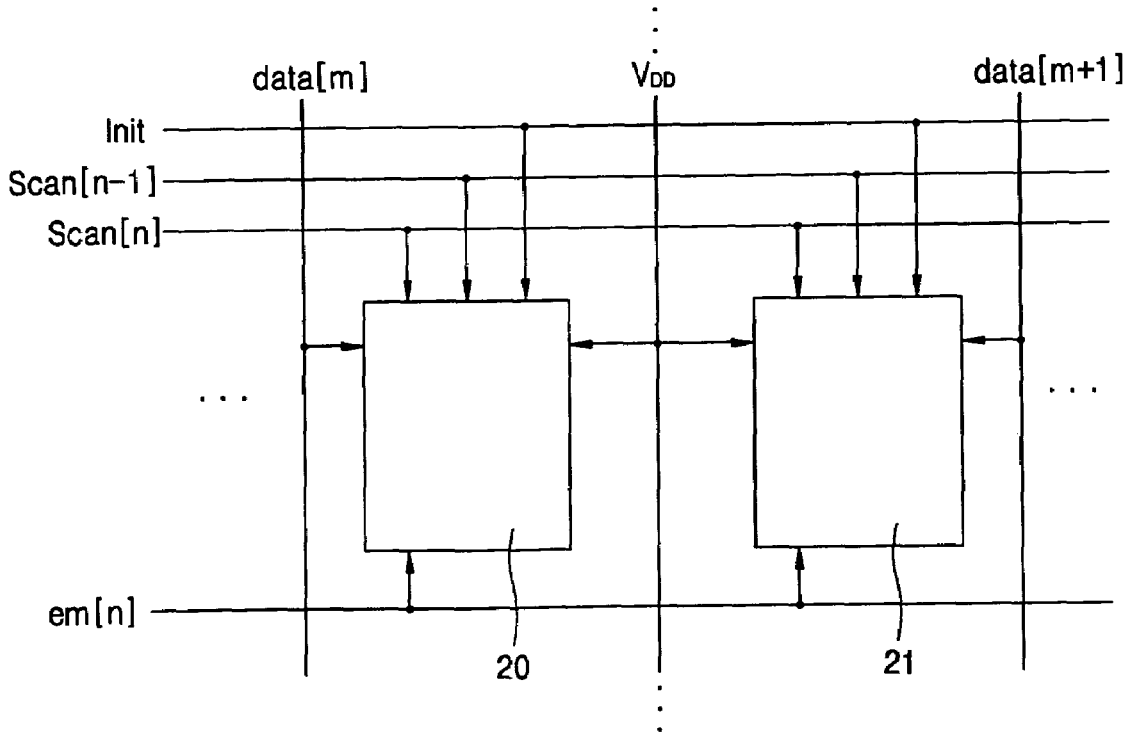
FIG. 2 (PRIOR ART)
FIG. 2 is a block diagram showing another conventional organic light-emitting display device.

Unlike the conventional organic light-emitting display devices shown in FIG. 1 and FIG. 2, some of the pixels of the organic light-emitting display devices, according to embodiments of the present invention, are coupled to fewer signal lines than the pixels of the conventional organic light-emitting display devices to obtain the same effect. Hence, according to exemplary embodiments of the present invention, the pixel circuits may have less transistors.

Figure 3:
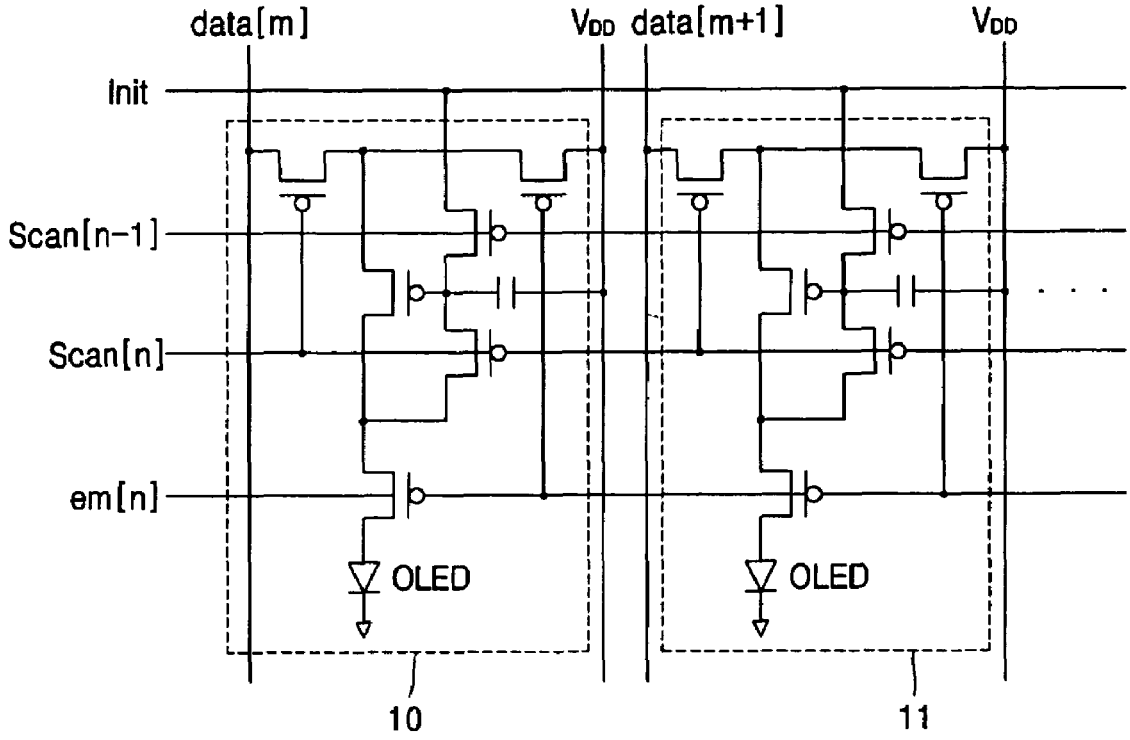
FIG. 3 (PRIOR ART)
FIG. 3 is a circuit diagram of the organic light-emitting display device of FIG. 1.
Figure 4:
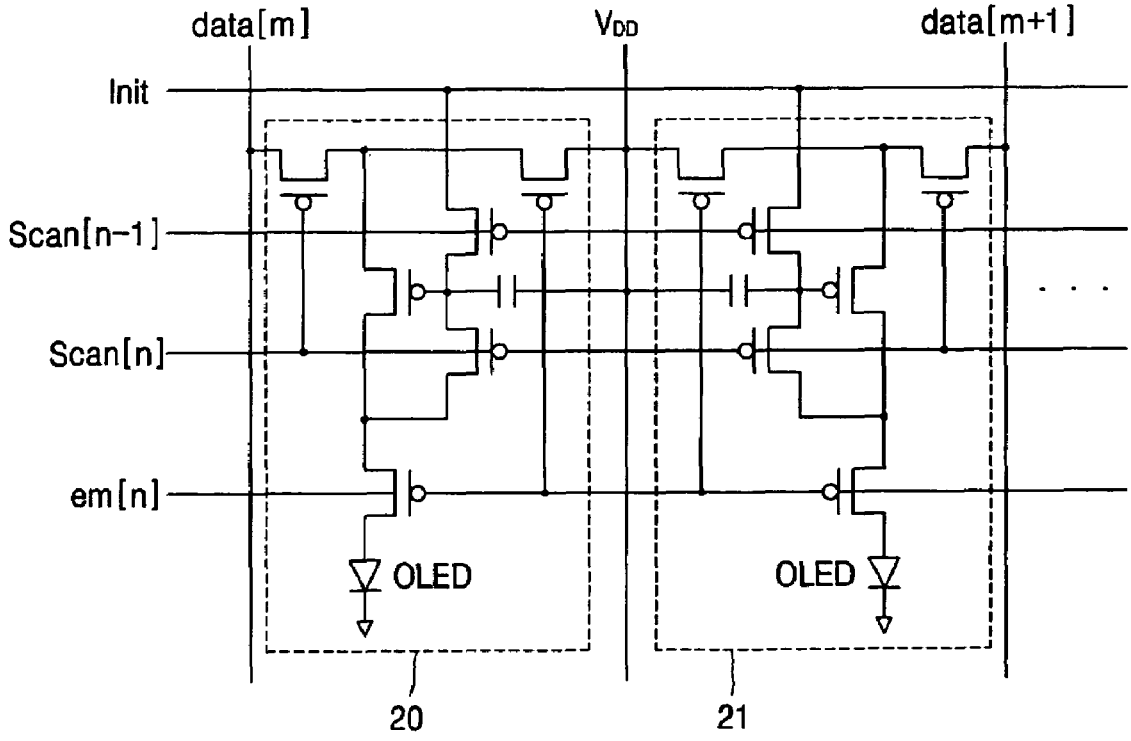
FIG. 4 (PRIOR ART)
FIG. 4 is a circuit diagram of the organic light-emitting display device of FIG. 2.

Referring to FIG. 7 and FIG. 8, the first pixel T1 of the organic light-emitting display device according to the present invention includes the TFTs M1, M2, M3, M4 and M5 and the capacitor C1, and second pixel T2 includes the TFTs M6, M7, M8, M9 and M10 and the capacitor C2. Consequently, each pixel of the organic light-emitting display device of the present invention uses five TFTs, but each pixel of the conventional organic light-emitting display device of FIG. 3 and FIG. 4 uses six TFTs. Accordingly, pixel circuits of the organic light-emitting display devices according to embodiments of the present invention may consume less power and take up less space considering the number of pixels comprising the organic light-emitting display devices.

Figure 9:
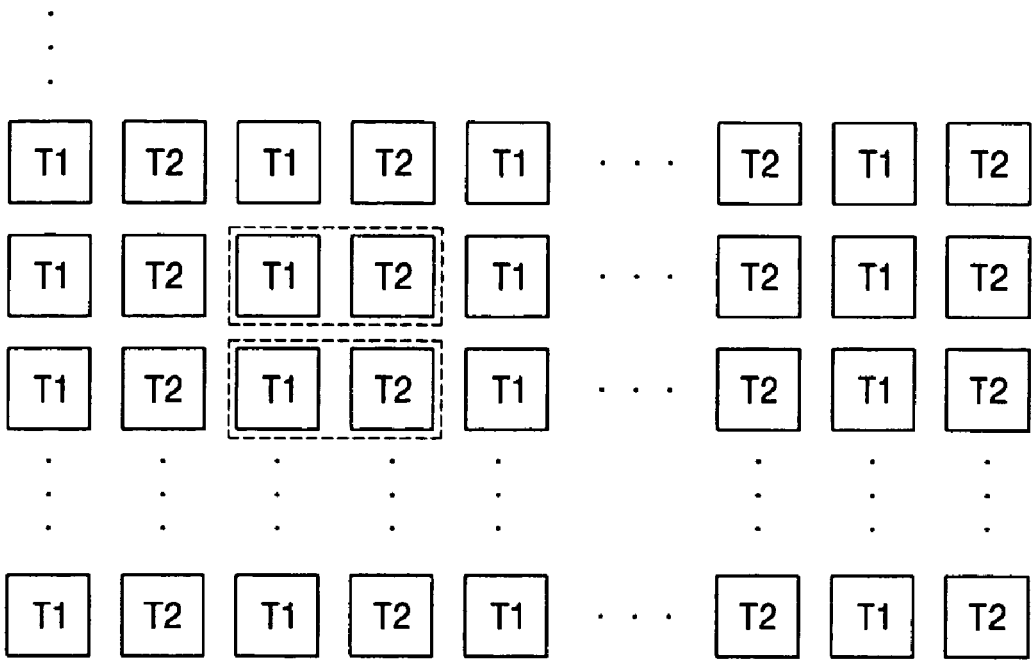
FIG. 9 shows a layout of pixels of an organic light-emitting display device according to an embodiment of the present invention.

FIG. 9 shows a layout of pixels comprising an organic light-emitting display device according to an embodiment of the present invention. Referring to FIG. 9, the first and second pixels T1 and T2 are alternately arranged in a row direction. However, the first pixels T1 and the second pixels T2 are continuously arranged in a column direction.

Figure 10:
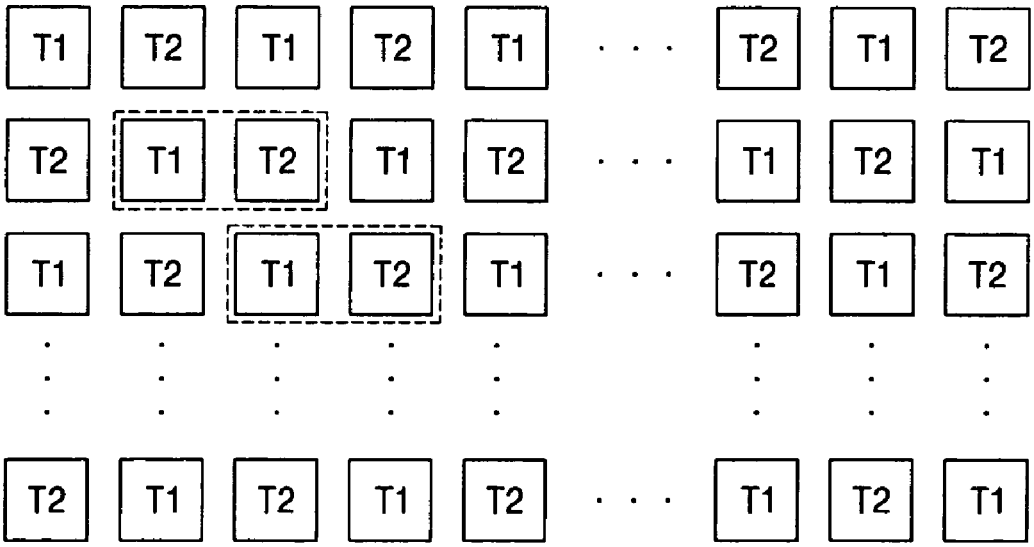
FIG. 10 shows a layout of pixels of an organic light-emitting display device according to another embodiment of the present invention.

FIG. 10 shows a layout of pixels comprising an organic light-emitting display device according to another embodiment of the present invention. Referring to FIG. 10, the first and second pixels T1 and T2 of the organic light-emitting display device are alternately arranged in a row direction. Furthermore, the first and second pixels T1 and T2 are alternately arranged in a column direction. When an organic light-emitting display device has the pixel layout of FIG. 10, a high power source $V_{DD}$ having a uniform voltage characteristic may be provided.

As described above, embodiments of the present invention disclose pixels commonly using the initialization switching element and power supply element to reduce the number of signal lines or power supply lines coupled to some pixels of the organic light-emitting display device and the number of TFTs constructing the pixels. This may decrease the power consumption and layout area of the organic light-emitting display device. Furthermore, the present invention may optimize the arrangement of the pixels commonly using the initialization switching element and power supply element to provide a uniform voltage to the respective pixels, thereby obtaining a uniform effect.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light-emitting display device, comprising:

a first pixel operating in response to a first power, an Nth scan signal, an Nth emission control signal, an Mth data signal and a first initialization voltage and generating a second power; and a second pixel operating in response to a third power, the Nth scan signal, an (N−1)th scan signal, an initialization signal, the Nth emission control signal, an (M+1)th data signal and the second power and generating the first initialization voltage, wherein the first initialization voltage is generated by the initialization signal and the (N−1)th scan signal, and the second power is generated by the first power and the Nth emission control signal.

2. The organic light-emitting display device of claim 1, wherein the first power is provided from an Nth power source line among a plurality of power source lines, and the third power is provided from an (N+1)th power source line among the plurality of power source lines.

3. The organic light-emitting display device of claim 1, wherein the first pixel comprises:

a first TFT having a first end provided with the Mth data signal and a second end provided with the second power, a gate of the first TFT being provided with the Nth scan signal;

a second TFT having a second end provided with the first power and a first end provided with the second power, a gate of the second TFT being provided with the Nth emission control signal;

a third TFT having a second end provided with the second power and a gate of which is provided with the first initialization voltage;

a fourth TFT having a second end provided with the first initialization voltage and a first end that is coupled to a first end of the third TFT, a gate of the fourth TFT being provided with the Nth scan signal;

a fifth TFT having a second end coupled to the first end of the third TFT and the first end of the fourth TFT, a gate of the fifth TFT being provided with the Nth emission control signal;

a first capacitor having a second end provided with the first power and a first end provided with the first initialization voltage; and an organic light-emitting diode having a first end coupled to a first end of the fifth TFT and a second end coupled to a fourth power.

4. The organic light-emitting display device of claim 1, wherein the second pixel comprises:

a sixth TFT having a first end provided with the (M+1)th data signal and a second end provided with the second power, a gate of the sixth TFT being provided with the Nth scan signal;

a seventh TFT having a second end provided with the initialization signal and a first end provided with the first initialization voltage, a gate of the seventh TFT being provided with the (N−1)th scan signal;

an eighth TFT having a second end provided with the second power and a gate of which is provided with the first initialization voltage;

a ninth TFT having a second end provided with the first initialization voltage and a first end coupled to a first end of the eighth TFT, a gate of the ninth TFT being provided with the Nth scan signal;

a tenth TFT having a second end coupled to the first end of the eighth TFT and the first end of the ninth TFT, a gate of the tenth TFT being provided with the Nth emission control signal;

a second capacitor having a second end provided with the third power and a first end provided with the first initialization voltage; and an organic light-emitting diode having a first end coupled to a first end of the tenth TFT and a second end coupled to a fourth power.

5. The organic light-emitting display device of claim 1, wherein series of the first pixel, continuously arranged in a first direction, and series of the second pixel, continuously arranged in the first direction, are alternately arranged in a second direction.

6. The organic light-emitting display device of claim 5, wherein the first direction corresponds to a direction in which data signal lines are arranged, and the second direction corresponds to a direction in which scan lines are arranged.

7. The organic light-emitting display device of claim 1, wherein first pixels and second pixels are alternately arranged in a first direction and in a second direction.

8. The organic light-emitting display device of claim 7, wherein the first direction corresponds to a direction in which data signal lines are arranged, and the second direction corresponds to a direction in which the scan lines are arranged.

9. An organic light-emitting display device, comprising:

a first pixel operating in response to a first power supplied from a first power source line among a plurality of power source lines having the same voltage level, an Nth scan signal, an Nth emission control signal, an (M+1)th data signal and a first initialization voltage and generating a second power; and a second pixel operating in response to the first power, the Nth scan signal, an (N−1)th scan signal, an initialization signal, the Nth emission control signal, an Mth data signal and the second power and generating the first initialization voltage, wherein the first initialization voltage is generated by the initialization signal and the (N−1)th scan signal, and the second power is generated by the first power and the Nth emission control signal.

10. The organic light-emitting display device of claim 9, wherein the first pixel comprises:

a first TFT having a second end provided with the (M+1)th data signal and a first end provided with the second power, a gate of the first TFT being provided with the Nth scan signal;

a second TFT having a first end provided with the first power and a second end provided with the second power, a gate of the second TFT being provided with the Nth emission control signal;

a third TFT having a first end provided with the second power and a gate provided with the first initialization voltage;

a fourth TFT having a first end provided with the first initialization voltage and a second end coupled to a second end of the third TFT, a gate of the fourth TFT being provided with the Nth scan signal;

a fifth TFT having a first end coupled to the second end of the third TFT and the second end of the fourth TFT, and a gate of the fifth TFT being provided with the Nth emission control is signal;

a first capacitor having a first end provided with the first power and a second end provided with the first initialization voltage; and an organic light-emitting diode having a first end coupled to a second end of the fifth TFT and a second end coupled to a third power.

11. The organic light-emitting display device of claim 9, wherein the second pixel comprises:

a sixth TFT having a first end provided with the Mth data signal and a second end provided with the second power, a gate of the sixth TFT being provided with the Nth scan signal; a seventh TFT having a second end provided with the initialization signal and a first end provided with the first initialization voltage, a gate of the seventh TFT being provided with the (N−1)th scan signal;

an eighth TFT having a second end provided with the second power and a gate provided with the first initialization voltage;

a ninth TFT having a second end provided with the first initialization voltage and a first end coupled to a first end of the eighth TFT, a gate of the ninth TFT being provided with the Nth scan signal;

a tenth TFT having a second end coupled to the first end of the eighth TFT and the first end of the ninth TFT, a gate of the tenth TFT being provided with the Nth emission control signal;

a second capacitor having a second end provided with the first power and a first end provided with the first initialization voltage; and an organic light-emitting diode having a first end coupled to a first end of the tenth TFT and a second end coupled to a third power.

12. The organic light-emitting display device of claim 9, wherein series of the first pixel, continuously arranged in a first direction, and series of the second pixel, continuously arranged in the first direction, are alternately arranged in a second direction.

13. The organic light-emitting display device of claim 12, wherein the first direction corresponds to a direction in which data signal lines are arranged, and the second direction corresponds to a direction in which scan lines are arranged.

14. The organic light-emitting display device of claim 9, wherein first pixels and second pixels are alternately arranged in a first direction and in a second direction.

15. The organic light-emitting display device of claim 14, wherein the first direction corresponds to a direction in which the data signal lines are arranged, and the second direction corresponds to a direction in which the scan lines are arranged.

* * * * *